US007182438B2

(12) United States Patent
Suganuma

(10) Patent No.: US 7,182,438 B2
(45) Date of Patent: Feb. 27, 2007

(54) ELECTROSTATIC INK JET HEAD

(75) Inventor: Atsushi Suganuma, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 204 days.

(21) Appl. No.: 10/882,277

(22) Filed: Jul. 2, 2004

(65) Prior Publication Data

US 2005/0001882 A1 Jan. 6, 2005

(30) Foreign Application Priority Data

Jul. 3, 2003 (JP) ..... 2003-191074

(51) Int. Cl.
*B41J 2/06* (2006.01)

(52) U.S. Cl. ..... 347/55

(58) Field of Classification Search ..... 347/9, 347/54, 55

See application file for complete search history.

(56) References Cited

U.S. PATENT DOCUMENTS 6,092,889 A * 7/2000 Nakamoto et al. ..... 347/55
6,158,844 A 12/2000 Murakami et al.
6,908,177 B2 * 6/2005 Suganuma ..... 347/55

FOREIGN PATENT DOCUMENTS

JP 10-230608 A 9/1998

* cited by examiner

*Primary Examiner*—An H. Do
(74) *Attorney, Agent, or Firm*—Sughrue Mion, PLLC

(57) ABSTRACT

The electrostatic ink jet head includes a head substrate, a first drive electrode and a second drive electrode which are formed as a double-layer electrode structure for each of the individual electrode units, an ink guide and an insulating substrate in which a through-hole is formed at a position corresponding to the ink guide. In this electrostatic ink jet head, ejection/non-ejection of the ink is controlled according to a superposed voltage obtained by applying voltages of the same polarity to the first drive electrode and the second drive electrode according to image data.

5 Claims, 5 Drawing Sheets

ELECTROSTATIC INK JET HEAD

BACKGROUND OF THE INVENTION

The present invention relates to an electrostatic ink jet head which controls ejection of ink by use of electrostatic force.

An electrostatic ejection ink jet recording method is a method of recording an image corresponding to image data on a recording medium, in which ink containing an charged fine particle component is used, a predetermined voltage is applied to each individual electrode unit of an ink jet head according to the image data, and thus ejection of the ink is controlled by use of electrostatic force. As a recording apparatus which adopts this electrostatic ejection ink jet recording method, for example, an ink jet recording apparatus as disclosed in JP 10-230608 A is known.

FIG. 7 is a conceptual view showing an example of a schematic configuration of an ink jet head of the ink jet recording apparatus as disclosed in the above-described publication. In an ink jet head 70 shown in FIG. 7, conceptually shown is only one individual electrode unit constituting the ink jet head of the ink jet recording apparatus as disclosed in the above-described publication, and the ink jet head 70 includes a head substrate 12, an ink guide 14, an insulating substrate 16, a drive electrode 72, and an opposing electrode 22.

The ink guide 14 is disposed on the head substrate 12, and in a center portion of the ink guide 14, a notch which serves as an ink guide groove 26 is formed in a vertical direction of the drawing. In the insulating substrate 16, a through-hole 28 is formed in a corresponding position where the ink guide 14 is disposed. The ink guide 14 extends through the through-hole 28 formed in the insulating substrate 16, and a tip end portion of the ink guide 14 protrudes upward from a surface of the insulating substrate 16, which is an upper surface in the drawing.

The drive electrode 72 is provided in a ring shape for each individual electrode unit on the upper surface of the insulating substrate 16 in the drawing so as to surround a periphery of the through-hole 28 formed in the insulating substrate 16. The head substrate 12 and the insulating substrate 16 are arranged apart from each other at a predetermined interval, and an ink flow path 30 is formed therebetween. The opposing electrode 22 is disposed at a position opposite to the tip end portion of the ink guide 14, and a recording medium P is disposed on a surface of the opposing electrode 22, which is a lower surface in the drawing.

FIG. 8 is a conceptual view showing a configuration example of a driver for the drive electrode. A driver 80 shown in FIG. 8 includes an FET (field effect transistor) 74 and resistor elements 76 and 78. A drain of the FET 74 is connected to the drive electrode 72, a source thereof is connected to the ground, and to a gate thereof, a control signal is inputted. The resistor element 76 is connected between a high-voltage power source and the drive electrode 72, and the resistor element 78 is connected between the input for the control signal and the ground.

In the driver 80, the control signal is switched to a high level or a low level according to the image data. When the control signal is switched to the high level, the FET 74 is turned on, and the drive electrode 72 is switched to a ground level. On the other hand, when the control signal is switched to the low level, the FET 74 is turned off, and the drive electrode 72 is switched to a high-voltage level of the high-voltage power source. Specifically, the drive electrode 72 is frequently switched between the ground level and the high-voltage level according to the image data (control signal).

When performing the recording, from a right side to a left side in FIG. 7, ink containing the fine particle component charged to the same polarity as that of a high voltage applied to the drive electrode 72 is circulated.

In a state where the drive electrode 72 is at the ground level, a field intensity in the vicinity of the tip end portion of the ink guide 14 is low, and the ink is not ejected from the tip end portion of the ink guide 14. In this case, a part of the ink rises along the ink guide groove 26 formed in the ink guide 14 due to capillarity, and rises above the upper surface of the insulating substrate 16 in the drawing.

On the other hand, when the high voltage is applied to the drive electrode 72, the ink, which has risen along the ink guide groove 26 of the ink guide 14 and has risen above the upper surface of the insulating substrate 16 in the drawing, is ejected from the tip end portion of the ink guide 14 due to repulsive force and is attracted by the opposing electrode 22 biased to a negative voltage, to thereby adhere onto the recording medium P.

In such a manner, the recording is performed while relatively moving the ink jet head 70 and the recording medium P disposed on the opposing electrode 22, and thus the image corresponding to the image data is recorded on the recording medium P.

Incidentally, in the case of a recording apparatus for which high definition and high speed are required, necessarily, a line head capable of recording an image simultaneously for one line will be required. For example, in the case of a recording apparatus with specifications of 1200 dpi (dot per inch) and 60 ppm (page per minute), in a line head capable of recording an image on a recording medium with a width of 10 inches, an enormous number of individual electrode units, i.e., 12,000 electrodes equivalent to the number of pixels for one line, and the same number of drive circuits for driving the respective individual electrode units, are arranged.

In this case, it is necessary that the individual electrode units and the drive circuits be packaged in the line head with extremely high density from a physical viewpoint in a direction of the line. The drive circuits use a high voltage, for example, of approximately 600 V, and accordingly, when the individual electrode units and the drive circuits are arranged with high density, a risk of an electrical discharge is increased. Hence, it is extremely difficult to attain both the high-density packaging and the high voltage.

Moreover, in the above-described drive circuits, when it is assumed that a current of 1 mA is caused to flow per individual electrode unit, a current of 12 A is caused to flow at the maximum through 12,000 individual electrode units. Hence, when the voltage to be switched is 600 V, power consumption reaches 7.2 kW. Even if efficiency of the high-voltage power source is 100%, a power source of 36 A under AC 200 V will be required. Still, only a single color image can be recorded on a recording medium of the A4 size, and this is too impractical in terms of a system.

SUMMARY OF THE INVENTION

It is an object of the present invention to provide an electrostatic ink jet head which solves the problems inherent in the above-described conventional technology, requires a small applied voltage for ejecting ink, accordingly has a small risk of electrical discharge, an electrical leak, or the like, and is capable of stably performing high-definition recording at high speed.

In order to attain the above-mentioned object, the present invention provides an electrostatic ink jet head for recording an image on a recording medium by ejecting ink containing charged fine particles by use of electrostatic force generated by applying predetermined voltages to individual electrode units, comprising: a head substrate; a first drive electrode and a second drive electrode, which are formed as a double-layer electrode structure for each of the individual electrode units; an ink guide disposed on the head substrate for each of the individual electrode units; and an insulating substrate in which a through-hole is formed at a position corresponding to arrangement of the ink guide for each of the individual electrode units, wherein: the head substrate and the insulting substrate are arranged apart from each other at a predetermined interval, a flow path of the ink is formed between the head substrate and the insulating substrate, the ink guide extends through the through-hole formed in the insulating substrate, a tip end portion of the ink guide protrudes from a surface of the insulating substrate, the surface being closer to the recording medium, the first drive electrode is disposed on a side of the insulating substrate with respect to the flow path of the ink, and the second drive electrode is disposed closer to the head substrate than the first drive electrode is; and ejection/non-ejection of the ink is controlled according to a superposed voltage obtained by applying voltages of the same polarity to the first drive electrode and the second drive electrode according to image data.

It is preferable that ejection/non-ejection of the ink is controlled according to a superposed voltage obtained by applying voltages of the same polarity and the same phase to the first drive electrode and the second drive electrode according to image data.

It is also preferable that ejection/non-ejection of the ink is controlled according to a superposed voltage obtained by applying a constant voltage to one of the first drive electrode and the second drive electrode when recording the image, and a predetermined voltage of the same polarity as a polarity of the constant voltage to the other thereof according to image data.

It is also preferable that the voltage applied to the first drive electrode and the voltage applied to the second drive electrode are equal to each other.

It is also preferable that a plurality of the individual electrode units are arranged in a matrix; the first drive electrodes of the individual electrode units arrayed in the same line in a first direction are connected to one another, and driven on a line basis in the first direction; and the second drive electrodes of the individual electrode units arrayed in the same line in a second direction are connected to one another, and driven on a line basis in the second direction.

This application claims priority on Japanese patent application No. 2003-191074, the entire contents of which are hereby incorporated by reference.

DETAILED DESCRIPTION OF THE PREFERRED EMBODIMENTS

An electrostatic ink jet head of the present invention will be described below in detail based on preferred embodiments shown in the accompanying drawings.

Figure 1:
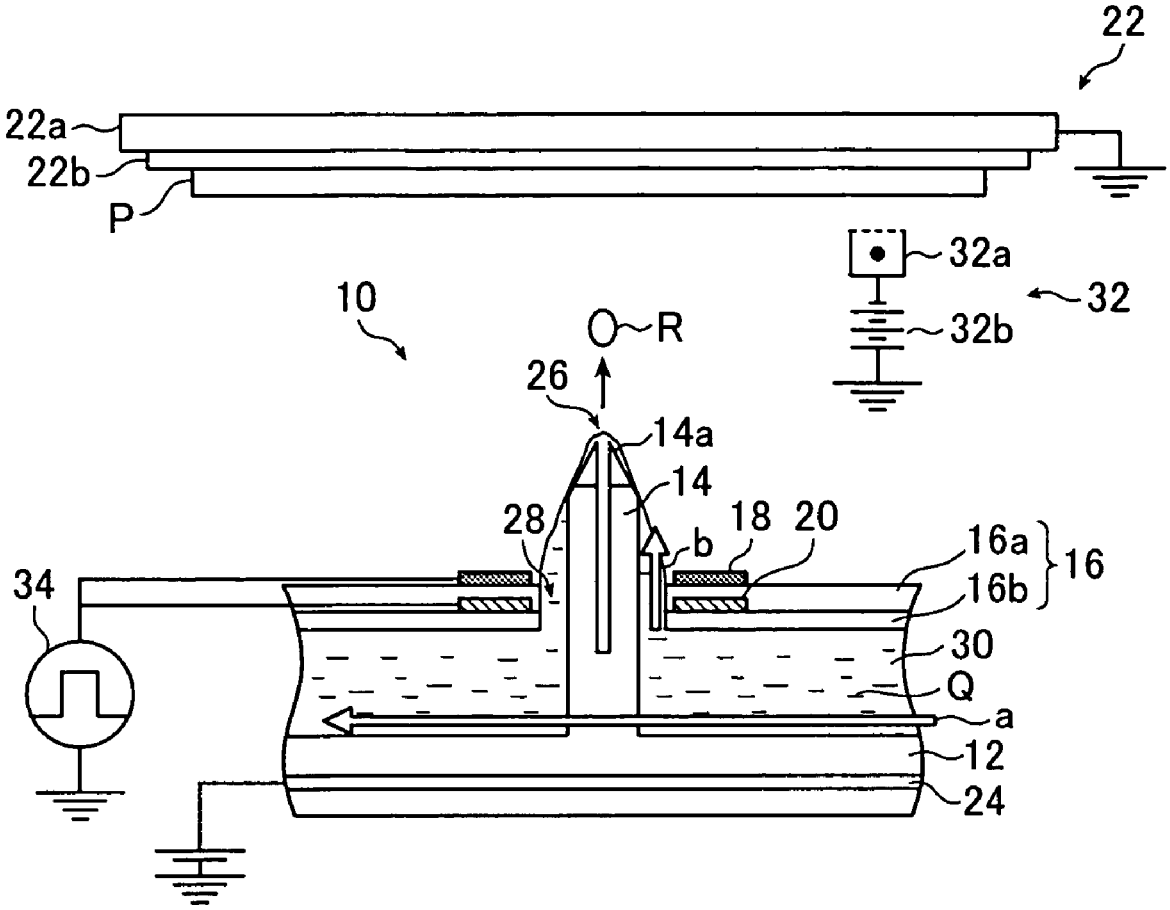
FIG. 1 is a conceptual view showing a configuration of an embodiment of an electrostatic ink jet head according to the present invention.
Figure 2:
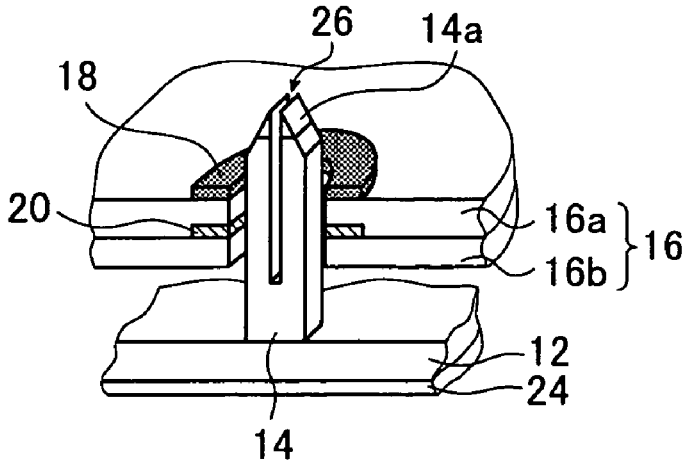
FIG. 2 is a perspective cross-sectional view schematically showing the electrostatic ink jet head shown in FIG. 1.

FIG. 1 is a conceptual view showing a configuration of an embodiment of an electrostatic ink jet head to which the present invention is applied, and FIG. 2 is a perspective cross-sectional view schematically showing the embodiment. An electrostatic ink jet head 10 shown in these drawings ejects ink containing a charged fine particle component such as pigment by means of electrostatic force to record an image corresponding to image data on a recording medium P. The electrostatic ink jet head 10 includes a head substrate 12, an ink guide 14, an insulating substrate 16 (substrates 16*a* and 16*b*), first drive electrode 18, and second drive electrode 20, and an electrophoresis electrode 24. An opposing electrode 22 is provided at a position opposite to the ink guide 14 of the ink jet head 10.

Note that in the example shown in FIG. 1, only one individual electrode unit constituting the ink jet head 10 is shown. Any number of individual electrode units may be provided, and physical arrangement of the individual electrode units is not limited at all. For example, it is also possible to constitute a line head by arranging a plurality of the individual electrode units one-dimensionally or two-dimensionally. Moreover, the ink jet head to which the present invention is applied is applicable to both of monochrome and color printings.

In the ink jet head 10 of the illustrated example, the ink guide 14 is disposed on the head substrate 12 for each individual electrode unit, and a notch which serves as an ink guide groove 26 is formed in a center portion of the ink guide 14 in a vertical direction of the drawing. The insulating substrate 16 is composed of an insulating substrate 16*a*, and an insulating substrate 16*b* closer to the head substrate 12 than the insulating substrate 16*a* is. In the insulating substrate 16 (substrates 16*a* and 16*b*), a through-hole 28 is formed in a corresponding position where the ink guide 14 is disposed. The ink guide 14 extends through the through-hole 28 formed in the insulating substrate 16, and a tip end portion of the ink guide 14 protrudes from a surface (upper surface in the drawing) of the insulating substrate 16, which is opposite with a surface closer to the head substrate 12.

The tip end portion of the ink guide 14 is formed into a substantially triangular (or trapezoidal) shape gradually tapered toward the opposing electrode 22, and metal is vapor-deposited on an extreme tip end portion from which ink is ejected. Although this metal deposition is not essential, it is preferable to perform the metal deposition because an effective dielectric constant of the extreme tip end portion of the ink guide 14 becomes substantially infinite to bring an effect of facilitating an intense electric field to be generated. Note that the shape of the ink guide 14 may be changed as appropriate.

The head substrate 12 and the insulating substrate 16 are arranged apart from each other at a predetermined interval, and an ink flow path 30 which functions as an ink reservoir (ink chamber) for supplying ink Q to the ink guide 14 is formed therebetween. Note that the ink Q in the ink flow path 30 contains a fine particle component charged to the same polarity as that of voltages applied to the first drive electrode 18 and the second drive electrode 20. When performing the recording, by an ink circulation apparatus (not shown), the ink Q is circulated at a predetermined speed in a predetermined direction, that is, from a right side to a left side in the ink flow path 30 in the illustrate example. Description will be made below by taking as an example of the case where colorant particles in the ink are positively charged.

Moreover, as shown in FIG. 2, the first drive electrode 18 is provided in a ring shape for each individual electrode unit on the upper surface of the insulating substrate 16 (16*a*) in the drawing, that is, on the surface closer to the recording medium P so as to surround a periphery of the through-hole 28 formed in the insulating substrate 16. Meanwhile, the second drive electrode 20 is provided in a ring shape for each individual electrode unit on a lower surface of the insulating substrate 16*a* in the drawing, that is, on an upper surface of the insulating substrate 16*b* in the drawing so as to surround the periphery of the through-hole 28 formed in the insulating substrate 16. For example, such a layered product composed of the insulating substrates 16*a* and 16*b* and the first drive electrode 18 and the second drive electrode 20 formed on the insulating substrate 16*a* and between the insulating substrates 16*a* and 16*b*, respectively, can be fabricated in the following manner. The second drive electrode 20 is first formed on the insulating substrate 16*b*, the insulating substrate 16*a* is then layered thereon, and the first drive electrode 18 is further formed on the insulating substrate 16*a*.

It is satisfactory if the first drive electrode 18 and the second drive electrode 20 are arranged with at least an insulating layer interposed therebetween, and a positional relationship between the electrodes, for example, an interval therebetween may be set as appropriate so as to obtain an effect of a double-layer electrode structure that will be described later in detail. Moreover, the shapes and sizes of the first drive electrode 18 and the second drive electrode 20 may be similar to or different from each other.

As in this embodiment, in the case of providing the first drive electrode 18 on the surface of the insulating substrate 16 (16*a*), which is closer to the recording medium P, it is preferable to provide an insulating layer so as to cover a part or all of the insulating substrate 16*a* and the first drive electrode 18 formed thereon in order to protect the first drive electrode 18.

Figure 5:
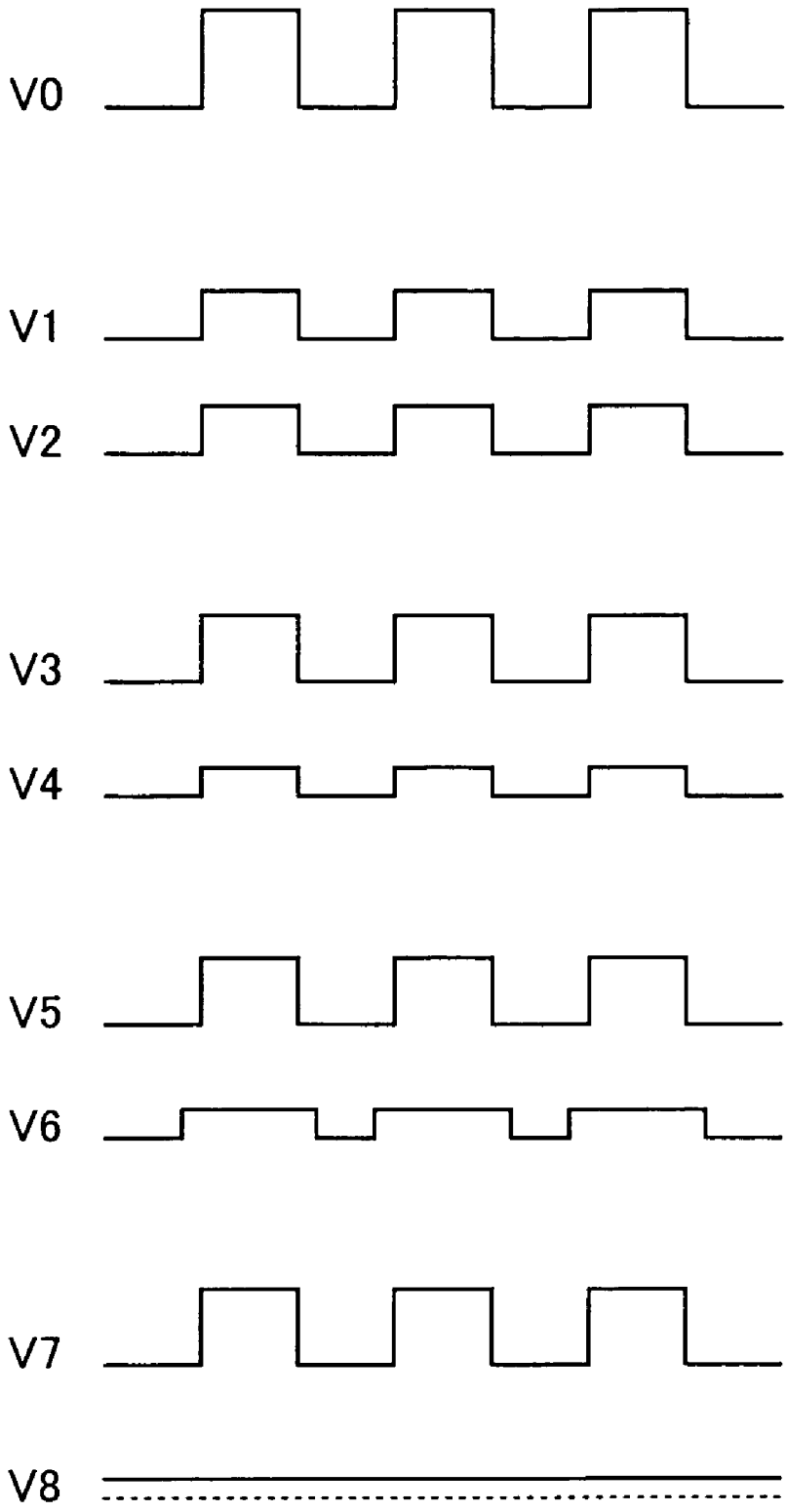
FIG. 5 is a conceptual diagram showing examples of drive voltages applied to a first drive electrode and a second drive electrode.
Figure 8:
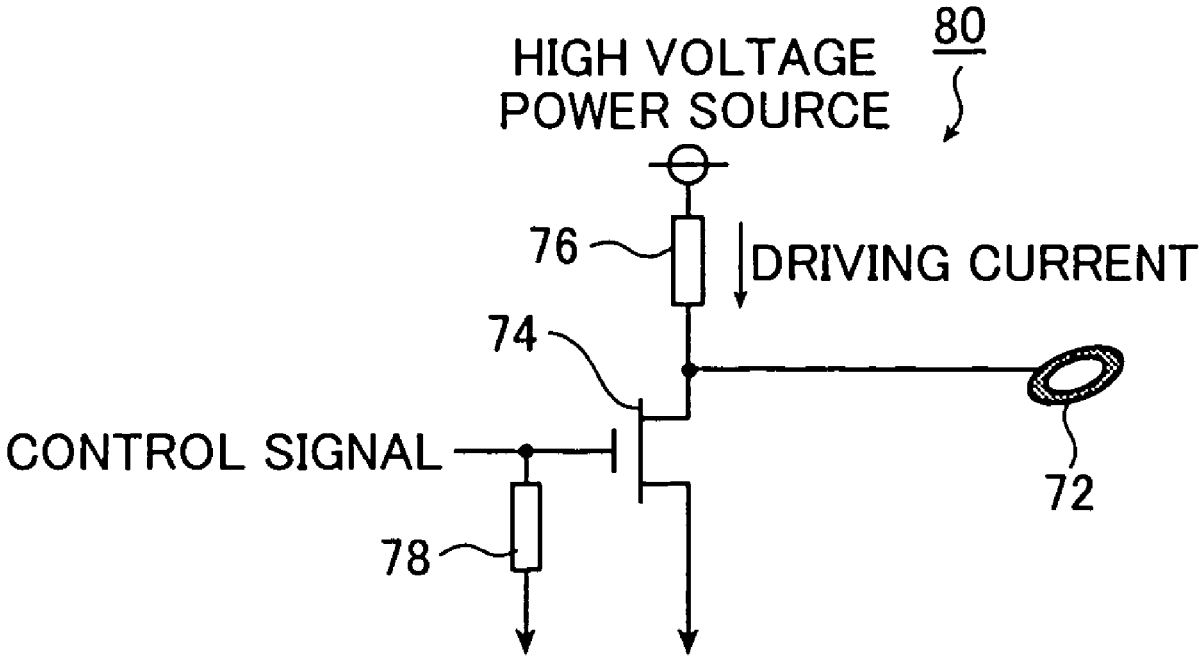
FIG. 8 PRIOR ART
FIG. 8 is a conceptual view showing a configuration example of a driver for the individual electrode unit of the conventional electrostatic ink jet head.

The first drive electrode 18 and the second drive electrode 20 are connected in parallel to a signal voltage source 34 for generating pulse signals (predetermined pulse voltages having, for example, 0 V at a low voltage level and 300 V at a high-voltage level) according to ejection data (ejection signals) such as image data and print data. Specifically, voltages of the same polarity, the same level, and the same phase, such as V1 and V2 shown in FIG. 5, are applied to the first drive electrode 18 and the second drive electrode 20 by the signal voltage source 34. The signal voltage source 34 can be composed of a high-voltage power source, and a driver (80) for controlling an application of the voltages from the high-voltage power source to the drive electrodes according to the image data (control signals), which are, for example, as shown in FIG. 8.

The opposing electrode 22 is disposed at the position opposite to the tip end portion 14*a* of the ink guide 14. The opposing electrode 22 is composed of an electrode substrate 22*a*, and an insulating sheet 22*b* disposed on a lower surface of the electrode substrate 22*a* in the drawing, that is, on a surface of the electrode substrate 22*a*, which is closer to the ink guide 14. The electrode substrate 22*a* is grounded. The recording medium P is supported on a lower surface of the opposing electrode 22 in the drawing, that is, on a surface of the opposing electrode 22, which is opposite to the ink guide 14, and specifically, on a surface of the insulating sheet 22*b*. For example, the recording medium P is electrostatically attached onto the above-described surface. The opposing electrode 22 (insulating sheet 22*b*) functions as a platen of the recording medium P.

At least when performing the recording, the surface of the insulating sheet 22*b* of the opposing electrode 22, that is, the recording medium P is charged by a charging unit 32, and maintained in a state of being charged with a predetermined negative high voltage, for example, −1.5 kV, which is inverse in polarity to the high voltages (pulse voltages) applied to the first drive electrode 18 and the second drive electrode 20. As a result, the recording medium P is constantly biased by the negative high voltage against the first drive electrode 18 and the second drive electrode 20, and electrostatically attached onto the insulating sheet 22*b* of the opposing electrode 22.

The charging unit 32 includes a scorotron charger 32*a* for charging the recording medium P with the negative high voltage, and a bias voltage source 32*b* for supplying the negative high voltage to the scorotron charger 32*a*. Note that charging means of the charging unit 32 for use in the present invention is not limited to the scorotron charger 32*a*, and a variety of charging means such as a corotron charger, a solid charger, and a discharge needle can be used.

Note that, though, in the illustrated example, the opposing electrode 22 is composed of the electrode substrate 22*a* and the insulating sheet 22*b*, and the recording medium P is electrostatically attached onto the surface of the insulating sheet 22*b* by being charged with the negative high voltage by the charging unit 32, the present invention is not limited to this. Another configuration may be adopted, in which the opposing electrode 22 is composed only of the electrode substrate 22*a*, the opposing electrode 22 (electrode substrate 22*a* itself) is connected to a bias voltage source of the negative high voltage and left constantly biased to the negative high voltage, and the recording medium P is electrostatically attached onto the surface of the opposing electrode 22.

Moreover, the electrostatic attachment of the recording medium P onto the opposing electrode 22, and the charging of the recording medium P with the negative high voltage or the application of the negative bias high voltage to the opposing electrode 22 may be performed by separate negative high-voltage sources. Furthermore, the supporting of the recording medium P by the opposing electrode 22 is not limited to the electrostatic attachment of the recording medium P, and other supporting methods and supporting means may also be used.

The electrophoresis electrode 24 is disposed below the ink flow path 30, and a predetermined positive voltage is applied to the electrophoresis electrode 24. In the illustrated example, the electrophoresis electrode 24 is disposed on the lower surface of the head substrate 12. In the present invention, the electrophoresis electrode 24 may be disposed at any position as long as the position is below the ink flow path 30, and for example, may be disposed inside the head substrate 12.

This electrophoresis electrode 24 generates a voltage induced according to the voltages applied to the individual electrode units when recoding an image, and concentrates the fine particle component of the ink Q in the ink flow path 30 by migrating the fine particle component concerned toward the insulating substrate 16. Therefore, the electrophoresis electrode 24 needs to be disposed on a side of the head substrate 12 with respect to the ink flow path 30. It is preferable that the electrophoresis electrode 24 be disposed upstream of the individual electrode units about the ink flow path 30. Note that the electrophoresis electrode 24 may be set in an electrically insulated state (high-impedance state).

When performing the recording by the ink jet head 10 as described above, the voltages of the same polarity and the same level are applied from the signal voltage source 34 to the first drive electrode 18 and the second drive electrode 20 in the same phase, that is, at the same timing, according to the image data. A field intensity between the tip end portion 14*a* of the ink guide 14 and the opposing electrode 22 reaches a field intensity necessary to eject the ink when the voltages are applied to both of the first drive electrode 18 and the second drive electrode 20, and an ink droplet R is ejected from the tip end portion 14*a*. The ejected ink droplet R flies by being attracted by the opposing electrode 22, arrives at a right position of the recording medium P, and forms the image.

As described above, the drive electrode of the present invention is constructed as a double-layer electrode, and accordingly, the voltage applied to the drive electrode can be reduced as compared with the case of ejecting the ink by means of a single-layer drive electrode as in the conventional manner.

Figure 3:
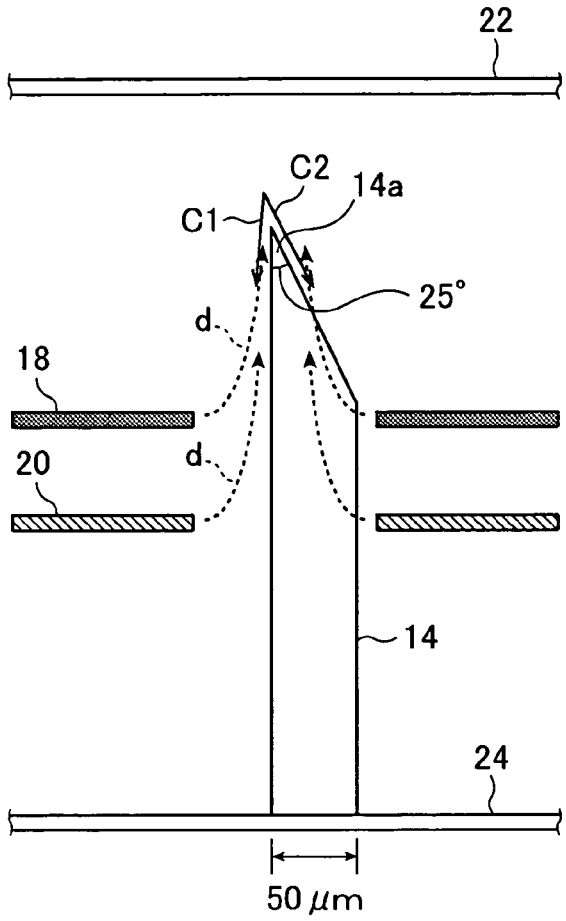
FIG. 3 is a conceptual view showing an actual model of an individual electrode unit of the electrostatic ink jet head according to the present invention.

In order to substantiate an effect of reducing the drive voltage by means of such a double-layer electrode structure, the inventors of the present invention have performed a simulation by use of an actual model shown in FIG. 3 in the present invention. As shown in FIG. 3, this actual model is one in which the ink guide 14 is mounted on the electrophoresis electrode 24, the first drive electrode 18 and the second drive electrode 20 are arranged about the ink guide 14, and the opposing electrode 22 is further disposed so as to oppose to the tip end portion 14*a* of the ink guide 14. In this actual model, there were obtained field intensities (V/m) of an ejection portion, that is, of the tip end portion 14*a* of the ink guide 14 in a state where the voltages of the first drive electrode 18 and the second drive electrode 20 were individually switched on/off. Here, in the actual model, an interval between the electrophoresis electrode 24 and the second drive electrode 20 was set to 5,000 μm, an interval between the second drive electrode 20 and the first drive electrode 18 was set to 800 μm, and an interval between the first drive electrode 18 and the opposing electrode 22 was set to 500 μm. Moreover, a positive voltage of 400 V was applied to the electrophoresis electrode 24, a negative high voltage of −1,500 V was applied as a bias voltage to the opposing electrode 22, and +300 V was applied as drive voltages to the first drive electrode 18 and the second drive electrode 20. The application of the negative bias high voltage of −1,500 V to the opposing electrode 22 is equivalent to the negative high voltage charging of −1,500 V to the recording medium P electrostatically attached onto the opposing electrode 22. Moreover, in the actual model of FIG. 3, with regard to the ink guide 14, only one side thereof, which was formed by cutting the ink guide 14 shown in FIG. 1 at the ink guide groove 26, was used. The ink guide 14 formed as described above was composed of zirconia (dielectric constant $\epsilon$=approximately 25) with a tip angle of 25°, a width (length in a horizontal direction in the drawing) of 50 μm, and a thickness (length in a direction normal to a space of the drawing, not shown) of 75 μm.

Figure 4:
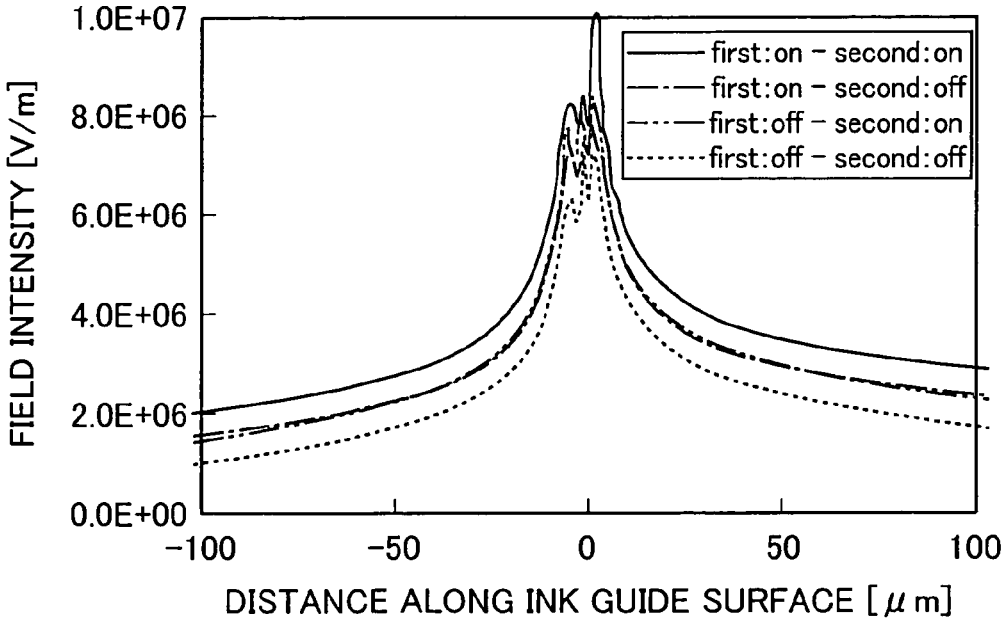
FIG. 4 is a graph showing relationships between field intensities and distances from an extreme tip end of an ink guide in the actual model shown in FIG. 3.

FIG. 4 shows results thus obtained.

An axis of abscissas of FIG. 4 represents distances from the extreme tip end of the ink guide 14, which is taken as 0, along the surface of the tip end portion 14*a*. Distances on the left-side surface of the tip end portion 14*a* in FIG. 3 (in a direction shown by an arrow C1) are shown as negatives, and distances on the right-side surface thereof in FIG. 3 (in a direction shown by an arrow C2) are shown as positives. Moreover, an axis of ordinates represents field intensities on points of the surfaces.

From FIG. 4, the following in the tip end portion 14*a* of the ink guide 14 is understood as a whole. Specifically, an increment of a field intensity (shown by a solid line in the drawing) in an ON state of the double-layer electrode, that is, when both of the first drive electrode 18 and the second drive electrode 20 are switched on (300 V), with respect to a field intensity (shown by a broken line in the drawing) in an OFF state of the double-layer electrode, that is, when both of the first drive electrode 18 and the second drive electrode 20 are switched off (0 V), becomes twice as much as an increment of a field intensity (shown by a chain dashed line or a chain double-dashed line in the drawing) when one of the first drive electrode 18 and the second drive electrode 20 is turned on (300 V), which corresponds to an ON state of the single-layer electrode. Here, in FIG. 4, the field intensity generated on the tip end portion 14*a* in a state where both of the electrodes are in the OFF state is caused by a bias voltage between the electrophoresis electrode 24 and the opposing electrode 22.

The results shown in FIG. 4 indicate that the field intensity formed on the tip end portion 14*a* by employing the double-layer electrode structure can be seen as a superposition of the field intensities individually formed by two electrodes of the structure concerned. Specifically, as conceptually shown in FIG. 3, an electric flux line d from the first drive electrode 18 and an electric flux line d from the second drive electrode 20 are added together, and the field intensity of the tip end portion 14*a* is increased. Hence, in the ink jet head 10 having the double-layer electrode structure of the present invention, the applied voltages (pulse voltages) to the drive electrodes, which are necessary to eject the ink droplet R, can be lowered to approximately a half of the voltage in the case of the single-layer electrode structure. Thus, a load on the drive circuit for driving each individual electrode unit can be reduced, thus also making it possible to use a low-voltage drive circuit. Moreover, the voltage of the power source (signal voltage source 34) can be lowered.

When the ink jet head 10 is formed such that each individual electrode unit is driven individually according to the image data, a configuration is adopted, in which the voltages of the same polarity are applied to the first drive electrode 18 and the second drive electrode 20. Thus, the voltages of both of the electrodes can be set smaller than a difference of the voltage levels between ON and OFF, which is necessary to stably control the ink ejection.

Moreover, when the voltages of the same polarity, the same phase, and the same level are applied to the first drive electrode 18 and the second drive electrode 20, as in the example of FIG. 1, the first drive electrode 18 and the second drive electrode 20 are connected in parallel to the single signal voltage source 34, and the voltages of the same level are applied thereto at the same timing. Thus, there is an advantage that the ink ejection can be controlled while lowering only the voltage level by means of a control system similar to that of the single-layer electrode structure.

The manner of applying the voltages of the same level to both of the electrodes as in the example of FIG. 1 is preferable in that the voltage levels of both of the electrodes can be lowered. However, in the present invention, the voltages applied to the first drive electrode 18 and the second drive electrode 20 may not be at the same level. For example, voltages of the same polarity and the same phase but different in level, such as V3 and V4 shown in FIG. 5, may be applied to the first drive electrode 18 and the second drive electrode 20. In this case, it is satisfactory if the voltage applied to each drive electrode is set so that the sum total of the field intensities formed by both of the electrodes has a magnitude sufficient for controlling the ink ejection.

Moreover, as long as the voltages applied to the first drive electrode 18 and the second drive electrode 20 are within a range where a difference between the ejection and non-ejection of the ink can be ensured, the phases of the voltages may be made different from each other as in V5 and V6 shown in FIG. 5. Specifically, a voltage (V6) in a range insufficient for ejecting the ink is applied to any one of the electrodes, and by applying a voltage (V5) to the other electrode, the ink ejection may be controlled. In this case, the ink is not ejected at the applied voltage (V6 in the illustrated example) to one of the first drive electrode 18 and the second drive electrode 20, and the ink is ejected when the voltages are applied to both of the first drive electrode 18 and the second drive electrode 20.

Furthermore, as shown by V7 and V8 shown in FIG. 5, a constant voltage (V8) in a range insufficient for ejecting the ink is applied to one of the first drive electrode 18 and the second drive electrode 20, only a voltage (V7) applied to the other electrode is switched on/off, and when the voltage (V7) is switched on, the ink is made to be ejected. Thus, the ejection/non-ejection of the ink may be controlled.

In any of the cases, it is satisfactory if the ejection/non-ejection of the ink is controlled such that the ink is ejected when a superposed voltage obtained by applying voltages to the first drive electrode 18 and the second drive electrode 20 exceed a predetermined value, and that, otherwise, the ink remains without being ejected.

In the case of adopting these forms, the first drive electrode 18 and the second drive electrode 20 are individually connected to signal voltage sources (drivers) different from each other, and both or one of the drivers is driven according to the image data, thus making it possible to control the ink ejection.

The electrostatic ink jet head according to the present invention is basically composed in the above-described manner. An operation of the electrostatic ink jet head of the present invention will be described below by taking an operation of the ink jet head 10 shown in FIG. 1 as a representative example.

In the ink jet head 10 shown in FIG. 1, when performing the recording, the ink Q containing the fine particle component charged to the same polarity as that of the voltages applied to the first drive electrode 18 and the second drive electrode 20, for example, with a positive (+) voltage, is circulated inside the ink flow path 30 in a direction shown by an arrow a in FIG. 1, that is, from the right side to the left side, by the ink circulation apparatus (not shown) including a pump and the like. In this case, the recording medium P electrostatically attached onto the opposing electrode 22 is charged with a voltage of an inverse polarity, that is, a negative high voltage, for example, −1,500 V. Moreover, a predetermined positive voltage is applied to the electrophoresis electrode 24.

When the pulse voltages are not applied to the first drive electrode 18 and the second drive electrode 20, or when the applied pulse voltages are at the low voltage level (0 V), a voltage (potential difference) between the first drive electrode 18 and the second drive electrode 20 and the opposing electrode 22 (recording medium P) is 1,500 V for an amount of the bias voltage, and the field intensity in the vicinity of the tip end portion 14*a* of the ink guide 14 is low. Accordingly, the ink Q is not ejected from the tip end portion 14*a* of the ink guide 14, and specifically, the ink Q is not ejected as the ink droplet R. However, in this case, due to an electrophoretic phenomenon and capillarity, a part of the ink Q in the ink flow path 30, and particularly the charged fine particle component contained in the ink Q, passes through the through-hole 28 of the insulating substrate 16, rises in a direction shown by an arrow b in FIG. 1, that is, from a lower side of the insulating substrate 16 to an upper side thereof, and is supplied to the tip end portion 14*a* of the ink guide 14.

On the other hand, when a pulse voltage at a high-voltage level (for example, 300 V) is applied to each of the first drive electrode 18 and the second drive electrode 20, the voltage (potential difference) between the first drive electrode 18 and the second drive electrode 20 and the opposing electrode 22 (recording medium P) reaches as high as 2,100 V because the pulse voltages of the two electrodes, each of which is 300 V, are superposed on 1,500 V for the amount of the bias voltage. Accordingly, the field intensity in the vicinity of the tip end portion 14*a* of the ink guide 14 is increased. In this case, the ink Q which has risen along the ink guide 14 and has risen to the tip end portion 14*a* above the insulating substrate 16, and particularly the charged fine particle component concentrated in the ink Q, is ejected as the ink droplet R containing the charged fine particle component from the tip end portion 14*a* of the ink guide 14 due to electrostatic force. Then, the charged fine particle component is attracted by the opposing electrode (recording medium P), which is biased to, for example, −1,500 V, and caused to adhere onto the recording medium P.

Dots are formed in the above-described manner on the recording medium P supported on the opposing electrode 22 by the ink ejection according to the image data while moving one or both of the ink jet head 10 and the recording medium P relatively to each other, and thus the recording is performed. Thus, the image corresponding to the image data can be recorded on the recording medium P.

In the above, only one individual electrode unit constituting the ink jet head 10 has been described, and the form in which each individual electrode unit is driven according to the image data has been described.

Next, a more preferred embodiment when the ink jet head 10 is formed as a line head in which a plurality of the individual electrode units are arranged two-dimensionally will be described below.

Figure 6:
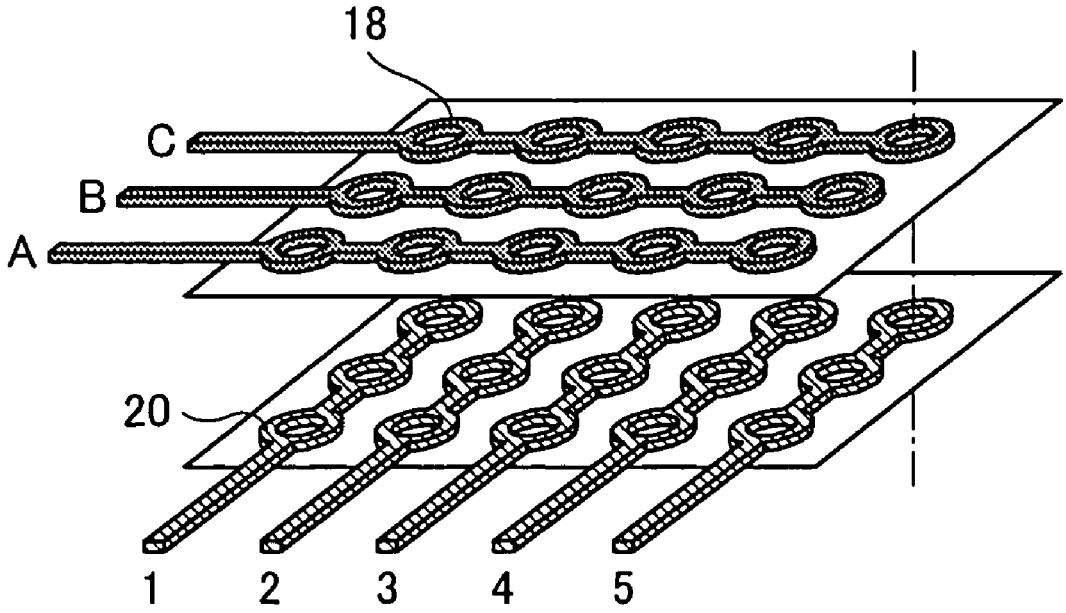
FIG. 6 is a schematic perspective view of an embodiment, showing arrangement of the first and second drive electrodes in the individual electrode units of the electrostatic ink jet head according to the present invention.
Figure 7:
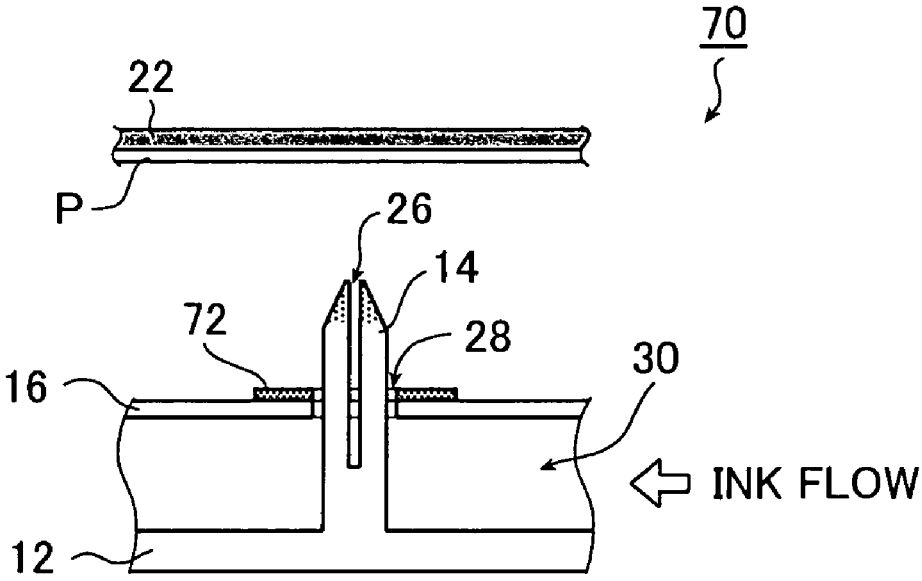
FIG. 7 PRIOR ART
FIG. 7 is a conceptual view showing a configuration example of a conventional electrostatic ink jet head.

In the ink jet head 10, the plurality of individual electrode units are arranged two-dimensionally in a row direction (main scanning direction) and a column direction (sub scanning direction). FIG. 6 is a conceptual view of an embodiment, showing arrangement of the first drive electrodes 18 and the second drive electrodes 20. As shown in FIG. 6, the first drive electrodes 18 in the plurality of individual electrode units arranged in the row direction (main scanning direction) are connected to one another, and the second drive electrodes 20 in the plurality of individual electrode units arranged in the column direction (sub scanning direction) are connected to one another.

When performing the recording, in this embodiment, the first drive electrodes 18 are sequentially driven to the high-voltage level (ON state) row by row, and the rest of the first drive electrodes 18 are driven to the ground level (ground state: OFF state). Moreover, the second drive electrodes 20 are driven to the high-voltage level or the ground level on a column basis according to the image data. Note that, as another embodiment, the first drive electrodes 18 and the second drive electrodes 20 may be driven interchangeably with the above-described manner.

In such a manner, the first drive electrodes 18 and the second drive electrodes 20 are constructed as the double-layer electrode, and arranged in a matrix. The first drive electrodes 18 and the second drive electrodes 20 control the ejection/non-ejection of the ink in the respective individual electrode units. Specifically, when the first drive electrodes 18 are at the high-voltage level and the second drive electrodes 20 are at the high-voltage level, the ink is ejected, and when one or both of the first drive electrodes 18 and the second drive electrodes 20 are at the ground level, the ink is not ejected.

As shown in FIG. 6, when the ink jet head 10 is provided with, for example, 15 individual electrode units, the 15 individual electrode units are arranged such that five electrodes (denoted by reference numerals 1, 2, 3, 4, and 5) are arrayed per row in the main scanning direction (row direction) and the individual electrode units are arrayed in three rows (denoted by reference symbols A, B, and C) in the sub scanning direction (column direction). When performing the recording, the first drive electrodes 18 corresponding to the five individual electrode units arrayed in the same row are driven at the same time and at the same voltage level. Similarly, the second drive electrodes 20 corresponding to the three individual electrode units arrayed in the same column are driven at the same time and at the same voltage level.

Moreover, for example, in the case of the ink jet head shown in FIG. 6, the five individual electrode units in the row A of the first drive electrodes 18 are arranged at a predetermined interval in the row direction. The same applies to the individual electrode units in the rows B and C. Moreover, the five individual electrode units of the row B are arranged at a predetermined distance from those of the row A in the column direction, and with regard to positions thereof in the row direction, the respective individual electrode units are arranged so as to be placed between the five individual electrode units of the row A and the five individual electrode units of the row C. Similarly, the five individual electrode units of the row C are arranged at a predetermined distance from those of the row B in the column direction, and with regard to positions thereof in the row direction, the respective individual electrode units are arranged so as to be placed between the five drive electrodes of the row B and the five drive electrodes of the row A.

In such a manner, the individual electrode units in the respective rows for the first drive electrodes 18 are arranged so as to be shifted from one another in the row direction, and thus one line recorded on the recording medium P is trisected in the row direction.

Specifically, the one line recorded on the recording medium P is divided in the row direction into a plurality of groups corresponding to the number of rows of the first drive electrodes 18, and sequentially recorded in a time division manner. For example, in the case of the example shown in FIG. 6, the rows A, B, and C of the first drive electrodes 18 are sequentially recorded, and thus an image corresponding to the one line is recorded on the recording medium P. In this case, as described above, the one line recorded on the recording medium P is trisected in the row direction, and the recording is sequentially performed therefor in the time division manner.

In the ink jet head 10 of this embodiment, which is driven by such a matrix drive method, for example, to the first drive electrodes 18, a predetermined voltage, for example, 300 V is applied sequentially for each row, and to the second drive electrodes 20, a predetermined pulse voltage, for example, a voltage ranging from 0 V to 300 V is applied according to the image data. Thus, it is possible to control the ejection/non-ejection of the ink Q (ink droplet R) containing the fine particle component such as pigment charged to the same polarity as those of the high voltages applied to the first drive electrodes 18 and the second drive electrodes 20. Specifically, in the ink jet head 10, when one or both of the first drive electrode 18 and the second drive electrode 20 are in the OFF state (with a voltage of, for example, 0 V), the field intensity in the vicinity of each tip end portion 14*a* of the ink guide 14 is low, and the ink Q is not ejected from the tip end portion 14*a* of the ink guide 14. When both of the first drive electrode 18 and the second drive electrode 20 are switched to the ON state (for example, 300 V), the field intensity in the vicinity of each tip end portion 14*a* of the ink guide 14 is increased, and the ink Q concentrated to the tip end portion 14*a* of the ink guide 14 is ejected from the tip end portion 14*a* by means of the electrostatic force.

As has already been described, in the ink jet head 10 of this embodiment, when at least one of the first drive electrode 18 and the second drive electrode 20 is at the ground level, the ink is not ejected, and only when the first drive electrode 18 is at the high-voltage level and the second drive electrode 20 is at the high-voltage level, the ink is ejected.

Specifically, the ink jet head 10 of this embodiment needs only to have a structure where the sufficiently high field intensity for the ink ejection is obtained when both of the first drive electrode 18 and the second drive electrode 20 are at the high-voltage level, and the field intensity becomes so low that the ink is not ejected when at least one of the first drive electrode 18 and the second drive electrode 20 are at the ground level. Related parameters to be described below may be determined as appropriate, which are: the shapes, sizes and arrangement (positional relationship) of the first drive electrodes 18 and the second drive electrodes 20; the levels of the high voltages applied to the first drive electrodes 18 and the second drive electrodes 20; the bias voltage of the opposing electrode 22 (or the charge voltage of the recording medium P); a thickness of the insulating substrate 16 (substrates 16*a* and 16*b*); the shape of the ink guide 14; and the like.

With such a configuration, according to this embodiment, while the first drive electrodes 18 and the second drive electrodes 20 are switched between the high-voltage level and the ground level, the voltages applied to the first drive electrodes 18 and the second drive electrodes 20 are lowered to approximately a half of the voltages in the case of the single-layer electrode, and accordingly, the power consumed for the switching is small. Hence, according to this embodiment, also in such an ink jet head for which high definition and high speed are required, power consumption can be reduced to a great extent. Note that this embodiment may also adopt a form in which the levels and phases of the voltages applied to the first drive electrodes 18 and the second drive electrodes 20 are different from each other as in the case of the form of driving each individual electrode unit individually. This embodiment may adopt a form in which the constant voltages are applied to one of the first drive electrodes 18 and the second drive electrodes 20 and the pulse voltages according to the image data are applied to the other electrodes. The ink ejection is controlled depending on whether or not such predetermined voltages are applied to both of the first drive electrodes 18 and the second drive electrodes 20.

Moreover, according to this embodiment, the individual electrode units are arranged two-dimensionally and driven in a matrix manner, and accordingly, the number of row drivers (number of switching elements and the like) for driving the plurality of individual electrode units in the row direction and the number of column drivers for driving the plurality of individual electrode units in the column direction can be reduced to a great extent. Hence, according to this embodiment, a packaging area and power consumption of the drive circuits for the individual electrode units arranged two-dimensionally can be reduced to a great extent. Moreover, the drive circuits are simplified, leading to a simple device configuration, and easy manufacturing process and maintenance of the device. Furthermore, the respective drive electrodes arranged as the respective individual electrode units are coupled to one another in the row direction or the column direction, and therefore, it becomes unnecessary to make a control line from each electrode in a one-to-one relationship. Thus, an electrode pattern is prevented from being congested, and facilitating formation of the electrodes. Furthermore, according to this embodiment, the respective individual electrode units can be arranged while providing relatively sufficient spaces therebetween, and accordingly, a risk of electrical discharge between the respective individual electrode units can be lowered extremely, and the high-density packaging and the high voltage can be both safely realized.

Note that, in the line head and the like in which the individual electrode units are arranged with high density, an interference of electric fields may occur between the adjacent individual electrode units. For this reason, it is also preferable to provide guard electrode between the first drive electrodes of the adjacent individual electrodes units, so as to shield electric flux lines directing to adjacent ink guides 14.

Note that, though the ink jet head 10 of the present invention adopts the double-layer electrode structure composed of the first drive electrodes 18 and the second drive electrodes 20, the present invention is not limited to this. Any number, which is two or more, of drive electrodes may be used, and electric flux lines from the drive electrodes of the respective layers may operate synergistically in the individual electrode units.

Moreover, the arrangement of the first drive electrodes 18 and the second drive electrodes 20 is not limited to the above-described example. The first drive electrodes 18 and the second drive electrodes 20 are arranged so that the electric flux lines from the first drive electrodes 18 and the second drive electrodes 20 may be added together, operate on the tip end portions 14*a* of the ink guides 14, and impart predetermined field intensities thereto. The first drive electrodes 18 and the second drive electrodes 20 may be provided to be separated from each other while interposing the ink flow path 30 therebetween.

Moreover, the electrostatic ink jet head of the present invention is not limited to one for ejecting the ink containing the charged coloring component. No particular limitations are imposed on the ink jet head as long as this ink jet head is a liquid ejection head for ejecting liquid containing charged particles. For example, the electrostatic ink jet head of the present invention can be applied to a coating apparatus for coating an object by ejecting liquid droplets by use of charged particles.

While the electrostatic ink jet head according to the present invention has been described above in detail, it is a matter of course that the present invention is not limited to the above-described embodiments, and that various improvements and modifications can be made without departing from the gist of the present invention.

As described above in detail, according to the present invention, the drive electrodes for controlling the ink ejection of the electrostatic ink jet head are formed into the double-layer structure and applied voltages of same polarity, and thus the voltages applied to the drive electrodes of the respective layers can be reduced. Therefore, the power consumption is small, the risk of the electrical discharge, the electrical leak, or the like is small, and operation stability of the apparatus can be realized. Consequently, an electrostatic ink jet head capable of stably performing high-definition recording at high speed can be provided. Moreover, the voltages applied to the drive electrodes can be reduced, whereby the load on the drive circuits is reduced, and options increase in selecting drive circuit elements, leading to a higher degree of freedom in designing the apparatus.

What is claimed is:

1. An electrostatic ink jet head for recording an image on a recording medium by ejecting ink containing charged fine particles by use of electrostatic force generated by applying predetermined voltages to individual electrode units, comprising:

a head substrate;

a first drive electrode and a second drive electrode, which are formed as a double-layer electrode structure for each of said individual electrode units;

an ink guide disposed on said head substrate for each of said individual electrode units; and an insulating substrate in which a through-hole is formed at a position corresponding to arrangement of said ink guide for each of said individual electrode units, wherein:

said head substrate and said insulting substrate are arranged apart from each other at a predetermined interval, a flow path of the ink is formed between said head substrate and said insulating substrate, said ink guide extends through the through-hole formed in said insulating substrate, a tip end portion of said ink guide protrudes from a surface of said insulating substrate, the surface being closer to the recording medium, said first drive electrode is disposed on a side of said insulating substrate with respect to the flow path of the ink, and said second drive electrode is disposed closer to said head substrate than said first drive electrode is; and ejection/non-ejection of the ink is controlled according to a superposed voltage obtained by applying voltages of the same polarity to said first drive electrode and said second drive electrode according to image data.

2. The electrostatic ink jet head according to claim 1, wherein ejection/non-ejection of the ink is controlled according to a superposed voltage obtained by applying voltages of the same polarity and the same phase to said first drive electrode and said second drive electrode according to image data.

3. The electrostatic ink jet head according to claim 1, wherein ejection/non-ejection of the ink is controlled according to a superposed voltage obtained by applying a constant voltage to one of said first drive electrode and said second drive electrode when recording the image, and a predetermined voltage of the same polarity as a polarity of the constant voltage to the other thereof according to image data.

4. The electrostatic ink jet head according to claim 1, wherein the voltage applied to said first drive electrode and the voltage applied to said second drive electrode are equal to each other.

5. The electrostatic ink jet head according to claim 1, wherein:

a plurality of said individual electrode units are arranged in a matrix;

said first drive electrodes of said individual electrode units arrayed in the same line in a first direction are connected to one another, and driven on a line basis in the first direction; and said second drive electrodes of said individual electrode units arrayed in the same line in a second direction are connected to one another, and driven on a line basis in the second direction.

* * * * *